United States Patent [19]

Shank

[11] 4,381,612

[45] May 3, 1983

[54] DRYER FABRIC FOR PAPERMAKING MACHINE AND METHOD

[75] Inventor: Samuel E. Shank, Greenville, S.C.

[73] Assignee: Wangner Systems, Inc., Greenville, S.C.

[21] Appl. No.: 269,838

[22] Filed: Jun. 3, 1981

[51] Int. Cl.[3] ..... F26B 13/08

[52] U.S. Cl. ..... 34/116; 34/123; 139/383 A; 139/408; 245/11

[58] Field of Search ..... 245/6, 11; 139/383 A, 139/408, 411, 413; 428/259, 296; 474/260, 264; 198/848, 851; 34/116, 123, 243 R

[56] References Cited

U.S. PATENT DOCUMENTS

| | | | |
|---|---|---|---|
| 475,598 | 5/1892 | McPherson | 245/11 |
| 2,266,631 | 12/1941 | Francis, Jr. | 28/1 |
| 4,186,566 | 2/1980 | Au Young | 34/57 A |
| 4,308,897 | 1/1982 | Westhead | 139/383 A |

*Primary Examiner*—Larry I. Schwartz
*Attorney, Agent, or Firm*—Dority & Flint

[57] ABSTRACT

A dryer fabric and method for drying a web W of paper material is disclosed which includes passing the web through a dryer having a plurality of heated cylinders and holding the web in contact against the heated cylinders by means of a dryer fabric 24 arranged as an endless traveling dryer fabric. The dryer fabric includes a plurality of elongated helix means 30 extending in a cross-wise direction constructed from a polymeric material characterized by stress and heat resistance to which said fabric is subjected during endless travel about the rollers at elevated drying temperatures. Joint means 32 joins adjacent ones of helix means successively together in a machine direction to form an endless belt of desired dimension. Spaced upper and lower generally parallel loop runs 34*a* and 34*b* in the helix means 30 define a smooth generally flat paper contacting surface. An open mesh 36 is defined in the fabric between adjacent joint means and runs of loops 34 along the cross-wise and machine directions of the fabric through which heated vapor and the like flow and are transferred outwardly from the paper web. Polymeric filler strands are inserted across the helix means closing the mesh to reduce flow. The edges of the fabric are heat sealed retaining the filler strands and helix means as integral fabric structure. In one embodiment, the filler strand includes low-melt nylon strands 42 which are heated to expand and occupy the helix strips more completely and which interlock the upper and lower loop runs providing a more stable fabric structure.

24 Claims, 6 Drawing Figures

DRYER FABRIC FOR PAPERMAKING MACHINE AND METHOD

BACKGROUND OF THE INVENTION

In the typical papermaking machine, an aqueous suspension of fibers is transformed into a paper web as it is processed through the different sections of the machine. One section of the papermaking machine is the dryer section wherein a wet paper web is passed about and held in intimate heat transfer relation with upper and lower arrays of heated cylinders in order to remove water from the paper web. The dryer section normally includes an upper and lower array of heated cylinders arranged and spaced in staggered, parallel rows which have a solid imperforate surface for contacting the paper web. Several dryer sections may be found in a papermaking machine in series and stages. The paper web is passed generally to and fro between the arrays of dryer cylinders in a generally serpentine manner to ensure that both sides of the paper web contact the cylinders. As the paper web passes over the dryer cylinders, it is held in intimate heat transfer contact therewith by a belt, commonly referred to as a dryer felt or dryer fabric which has been made endless by techniques which are well known in the field of papermaker's felts and clothing.

In the past, dryer fabrics generally have been substantially impervious structures of either woven or needle construction. However, the impervious structures, commonly known as dryer felts, do not ventilate sufficiently and thus serve to confine heated vapors in certain "pockets" created in the dryer section which cause uneven drying and affect paper quality. Thus, the trend is toward open weave fabrics which have been found to have desirable characteristics and many non-woven structures, such as needle felts, plastic perforated and helical belts, and the like have also been found suitable due to their increased permeability. Typically, these plastic, non-woven fabrics have yielded permeabilities as high as a thousand cublic feet per minute.

The non-woven plastic helical fabric is desirable because it has fewer if any "knuckles," as in the case of woven fabric, and thus provides increased surface area for contacting and holding the paper. This paper supporting surface is also smoother and reduces markings on the paper. The plastic material and belt construction hold up extremely well under the stresses encountered when traveling endlessly at high speeds, typically 3000 fpm, about the belt rollers in contacting the paper web.

The high permeability of non-woven plastic belting provides increased pocket ventilation and hence drying, but can also lead to increased fluttering of the paper web sheet against the dryer fabric through a phenomena known as air "pumping." This is due to frictional drag on the air surrounding the moving fabric which causes the air to move with the fabric. As the fabric contacts the cylinders or belt rolls, this air is forced through the fabric with the air movement away from the roll or dryer at a converging nip and toward the roll or dryer at a diverging nip. The effect of these forces is the net inflow of air into a dryer pocket, resulting in an outlow of air at the front and back sides of the machine. This turnover of air or air "pumping" is appreciable with highly permeable fabrics travelling at high speeds which can cause disruptive sheet flutter. If a highly permeable dryer fabric is operated at high speeds with a paper web of low strength, the paper web may break, be damaged, or be marked by fluttering against the fabric.

Heretofore, there has been no practical manner of varying the permeability of the basic fabric and, thus, provide fabric for a complete range of applications and control sheet flutter. For example, a dryer section closest to the wet section of a papermaking machine typically requires a fabric characterized by low permeability owing to its relative weak strength of the paper at this stage. High permeability is desired at dryer sections at the latter drying stages and for heavier paper grades. Finer paper grades do not contain as much water and thus do not require a fabric of high permeability nor is such desired since paper flutter of the light sheet is likely.

In an unrelated use, the wire mesh openings of a wire conveyor belt have been obstructed by plastic rods and the pressure of freezing air flow therethrough increased to minimize the variability of the air flow and provide the the result of uniform freezing of layered food conveyed thereon in U.S. Pat. No. 4,186,566, which is directed to apparatus for quick freezing foods.

Accordingly, an important object of the present invention is to provide a construction for a plastic non-woven dryer fabric for a papermaking machine and method by which a desired permeability characteristic may be built into the fabric.

Another important object of the present invention is to provide a non-woven dryer fabric and method having a permeability ranging from as low as 50 to as high as 1000 cfm.

Yet another important object of the present invention is to provide a plastic non-woven dryer fabric with a closed mesh which advantageously withstands the high stresses and temperatures on a papermaking machine.

Still another important object of the present invention is to provide a non-woven polymeric dryer fabric having a closed mesh to control sheet flutter and provide a smooth surface to dry and produce very fine paper.

Yet another important object of the present invention is the method of constructing a basic dryer fabric wherein the permeability of the fabric may be subsequently altered to provide a fabric having a desired permeability for a particular application.

SUMMARY OF THE INVENTION

According to the present invention, the above objectives are accomplished by providing a non-woven dryer fabric which includes a plurality of helixes formed from a polymeric material having sufficient plasticity to withstand the stress of continuous travel about belt rollers and heated cylinders on a papermaking machine without permanent deformation or heat damage. The helixes are joined together by pintle means and the loops of the helixes are closed by means of filler strands of synthetic material which are inserted in the helix loops which can be utilized according to the method to produce a complete range of fabric permeabilities suitable for any papermaking application. The strands may be advantageously heat treated to expand and substantially fill the helical loops for maximum fabric closure and low permeability characteristics. Alternately, any one of a complete range of permeabilities may be had according to the filling technique to provide fabric for any papermaking application. The polymeric helixes and strands may be sealed together at the edges of the dryer fabric by passing a hot knife along the edge and applying cement to make an integral fabric structure.

DESCRIPTION OF A PREFERRED EMBODIMENT

The invention relates to a m and construction of a dryer fabric for a dryer section of a papermaking machine. Since such papermaking machines are well known in the art, only so much of a papermaking machine as is necessary to an understanding of the invention will be illustrated.

Figure 1:
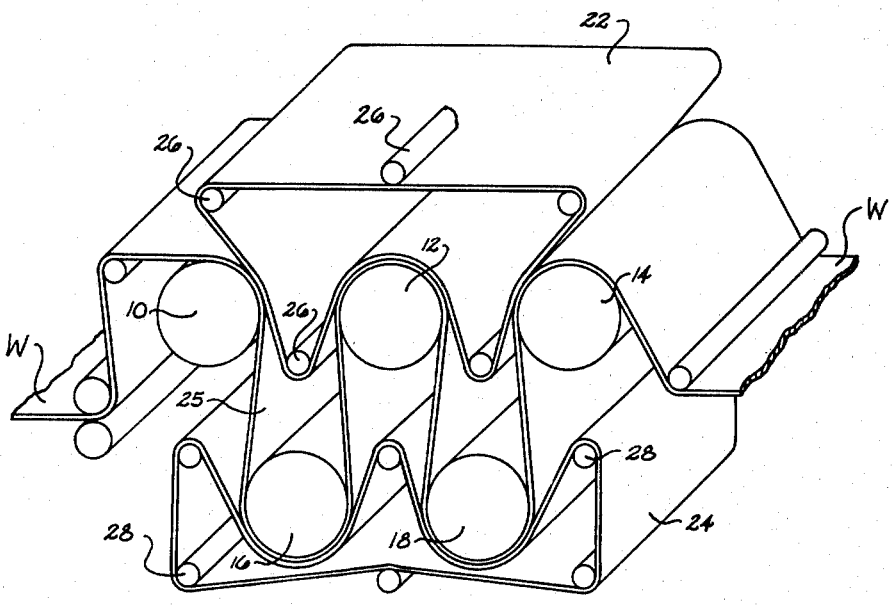
FIG. 1 is a perspective view illustrating a dryer section of a papermaking machine incorporating a non-woven dryer fabric constructed in accordance with the invention.

Accordingly, FIG. 1 is a simplified view of a portion of a dryer section of a papermaking machine wherein a continuous sheet-like web W of paper material is traveling from left to right. Several of such sections may be utilized in succession to dry the paper in stages. The dryer section includes an upper and lower array of horizontally disposed heated dryer cylinders which may be either of a perforated or imperforated construction. The upper array of heater cylinders includes cylinders 10, 12 and 14 with the lower array including cylinders 16 and 18. The continuous web of paper is received from the press section of the machine and is passed in a serpentine manner about the dryer cylinders as illustrated. The web first passes over and about upper cylinder 10, under cylinder 16, and then over cylinder 12 and so forth in a serpentine manner until it leaves the dryer section of the papermaking machine. Water and other fluids within the paper web are evaporated due to the paper contacting the cylinders.

The web W is guided through the dryer section and held in contact with the heated cylinders 10, 12, and 14 by means of an upper fluid permeable dryer fabric or belt 22, and a lower fluid permeable belt 24 guides and holds the paper web in contact with the lower cylinders 16 and 18. The dryer fabrics 22 and 24 are identical in their fabric construction as made in accordance with the present invention as will be more fully explained hereinafter. By contacting the paper Web W, the dryer fabrics press and maintain the web in intimate heat transfer relationship with the dryer cylinders whereby the cylinders remove water or other fluids from the web.

Felt rollers for the dryer fabric are provided on the machine such as 26 for the upper fabric and 28 for the lower fabric. The felt rollers maintain sufficient tension on the dryer fabric to ensure that the paper web W is maintained in good heat transfer contact with the dryer cylinders.

The drying process is outwardly from the heated cylinders through the paper web and through the dryer fabric. The "pockets" referred to in the background material are typically created in the enclosed areas bounded by the dryer fabric, paper web, and the heat cylinders, for example, area 25 bounded by fabric 22, cylinder 16, and the web W in FIG. 1. Accordingly, the dryer fabric must have a sufficient permeable construction in order to ventilate these pockets. But the permeability of the fabric should not be so high that the previously described disruptive sheet "flutter" between the paper web and the dryer fabric can occur whereby marking of the paper and derrogation of quality result.

In conventional woven dryer fabrics, dryer fabric construction is described in terms of yarns or filaments extending in the machine direction (the direction in which the web travels) and yarns or filaments extending in the cross-wise direction (across the width or transverse to the direction in which the web travels).

Figure 2:
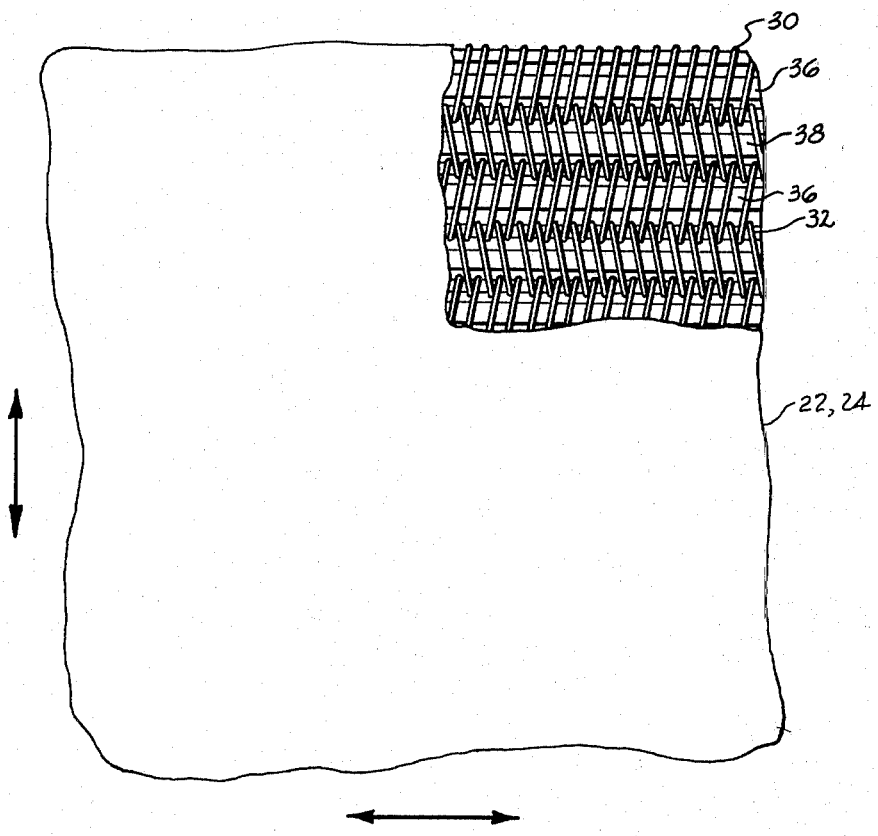
FIG. 2 is a top plan view of a dryer fabric constructed according to the present invention.

Referring now in more detail to the present invention, a dryer fabric 22, 24 is illustrated in FIG. 2 wherein the fabric consists of a series of helix means in the form of helical strips 30 which extend cross-wise in the fabric across the entire width thereof. The individual helical links 30 are constructed from a suitable polymeric material such as a monofilament polyester in order to have sufficient plasticity to withstand the stress of endless travel over the felt rollers under extreme temperatures and an acceptable shrink range. A suitable material is type 933 polyester monofilament made by American Hoechst Co. having a 0.7 mm diameter. Joint means for joining the adjacent helix lengths successively together in the machine direction is provided by pintles 32. The pintles are monofilament and extend through the overlapping loops of adjacent helix strips joining same together successively to make dryer fabric of a desired dimension in the machine direction which is ultimately made endless by joining the fabric end-to-end. Typically, such fabrics range from 8 to 340 inches cross-wise (width) and from 18 to 70 yards from end-to-end (circumference).

Figure 4:
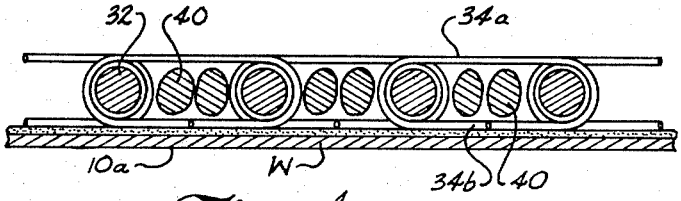
FIG. 4 is a schematic elevation illustrating a dryer fabric constructed according to the present invention which is illustrated as pressing a paper web against a heated cylinder of the dryer section of a papermaking machine.

As illustrated, each helix strip 30 includes loops or spirals 34 which have an upper run **34*a* and lower run 34*b* which are generally parallel to present a flat and smooth paper contacting surface for the fabric. An open mesh 36 is defined in the fabric face between adjacent pintle joints and runs of the loops across the length and width of the fabric through which air and/or vaporized water are transferred outwardly from the paper web as best seen in FIG. 4**.

In accordance with the present invention, a method and structure is provided by which the permeability of a basic non-woven plastic fabric may be varied and by which detrimental sheet flutter may be controlled. The open mesh of the fabric is closed by the insertion of filler means in the form of monofilament strands 38 extending across the entire width of the fabric in a cross-wise direction. The strands may be any suitable polymeric material which is compatible with the environment of the dryer section of the papermaking machine such as nylon, polyester, or polypropylene.

Figure 3:
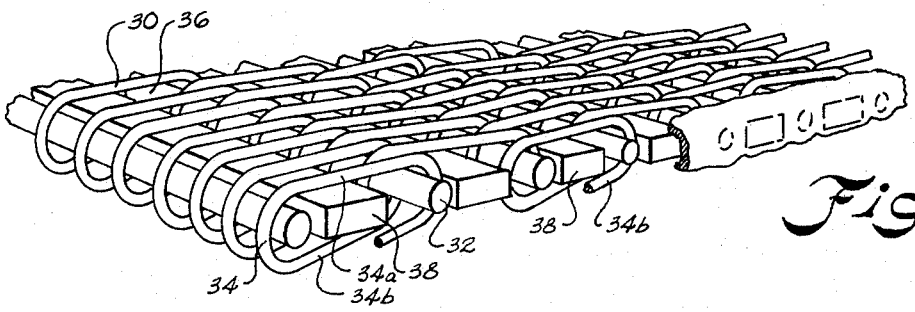
FIG. 3 is a perspective view illustrating a dryer fabric constructed according to the present invention.

Different arrangements have been found, according to the present invention, as an expedient to producing dryer fabric having permeability characteristics over a complete range of dryer and paper grade applications. As illustrated in FIGS. 2 and 3, the monofilament strands include a flat nylon strip 38 inserted in the helix loops 34 between adjacent pintles 32 in the cross-wise direction. Such has been found satisfactory to produce a permeability of approximately 450 cu. ft./min. (cfm). FIG. 4 illustrates a dryer fabric wherein a pair of filler strands 40 are inserted between adjacent pintle joints 32 in the cross-wise direction wherein the two strands have a somewhat flattened circular cross-section which have been found to produce a permeability of approximately 700 cfm. The fabric is illustrated as holding the paper web W in intimate contact with the heated surface 10*a* of cylinder 10.

Figure 5:
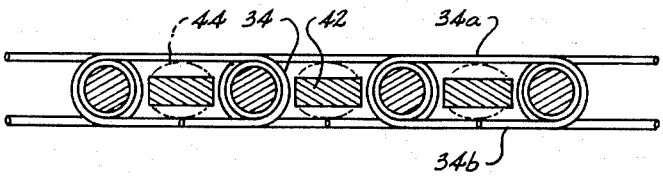
FIG. 5 is an elevation illustrating a dryer fabric according to the present invention and means of closing the open mesh portion of the fabric by heat treatment of a filler.
Figure 6:
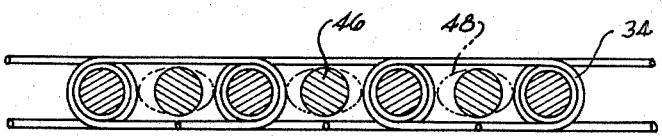
FIG. 6 is an elevation illustrating an alternate dryer fabric and heat-treated filler therefor.

Referring now to FIG. 5, a highly advantageous form of the invention is illustrated wherein a dryer fabric of lower permeability is produced by inserting a low melt polymeric material such as a nylon or polypropylene strand 42 in the cross-wise direction across the fabric in a generally flat configuration. By low-melt, it is meant a strand of polymeric material which will begin to melt and flow at about 350 to 375 degrees farenheit, i.e. the operating temperature of the dryer section.

The polyester helical fabric is initially placed on a conventional stretcher frame in its finished end-less construction and heated to a temperature of approximately 400 to 450 degrees farenheit at a pressure of 40 to 45 pounds per linear inch until the desired dimension of the fabric in the machine direction is obtained. The pressure (tension) and temperature are then reduced to a level at which the fabric will operate in a typical dryer section and the fabric removed. By this process, the basic dryer fabric is heat set and thus thermally stable whereby its dimensions will remain unchanged within required tolerances during use under normal dryer operating pressure temperature, i.e. 250 to 350 degrees farenheit. Filler strands 42 are then inserted and subjected to heat treatment at a temperature of 350 to 400 degrees farenheit which causes the low-melt monofilament to flow and expand much like a balloon being blown up at 44. Thus, the temperature range for treating the low-melt filler does not affect the stability of the basic fabric. Heatsetting may be done prior to or simultaneously with heat treating of the low-melt nylon filler strand. If done simultaneously, the heat treatment is continued beyond that required for the low-melt filler to heat set the fabric.

Since it is virtually impossible for the helix loops to be uniform throughout the fabric and owing to the small size of the helix loops, it is difficult to fit each helix strip with a relative large filler strand to make fabric having a low permeability. However, by using a heat-treated strand, a filler strand of smaller cross-sectional configuration can be used which easily inserts and slides inside each of the loops, regardless of their non-uniformity, across the fabric. While the strand would not close the mesh sufficiently in its untreated state, when heated and allowed to flow, such affords substantial mesh closure and low permeability characteristics. In such a manner, it has been possible to make dryer fabric with a permeability as low as 50 cfm. Round, easily insertable strands 46 may also be utilized and heat-treated at 48. Heat-treated strands have been found to expand vertically between upper and lower loop runs to tighten and interlock the fabric which is an expedient to fabric integrity and in providing a stable fabric paper contacting surface on high speed, end-less travel machines.

After the fabric construction is complete, according to the structure and method herein, the fabric is trimmed to the ordered width and a hot knife is passed along the edges to seal the edges joining the filler strand and helix strips as integral fabric structure. In addition, a width of cement may be applied to the fabric edges for increased stability.

Thus, it can be seen that a highly advantageous dryer fabric and method may be had for a non-woven dryer fabric wherein the permeability characteristics of the basic fabric may be modified to provide a complete range of dryer fabric permeabilities for virtually all papermaking applications.

While a preferred embodiment of the invention has been described using specific terms, such description is for illustrative purposes only, and it is to be understood that changes and variations may be made without departing from the spirit or scope of the following claims.

What is claimed is:

1. In apparatus for drying a web of paper material in a dryer section of a papermaking machine which includes a plurality of heated cylinders over which the web travels for drying, an endless traveling dryer belt carried about rollers and adjacent said cylinders contacting said web to hold said web against said heated cylinders for drying, air defined in a space between said cylinder and dryer fabric being forced through said web and dryer belt drying said paper web, said dryer belt being open to the passage of air therethrough, the combination of a non-woven fabric belt which includes a plurality of elongated helix means extending in a cross-wise direction constructed from a polymeric material having a degree of plasticity for accommodating stress during repeated travel over said rollers at elevated drying temperatures, said helix means including flattened loops having generally parallel upper and lower runs of said material presenting a smooth generally flat web contacting surface, joint means joining adjacent ones of said helix means successively together in a machine direction to provide an endless dryer belt of desired dimension; an open fabric mesh defined between said joint means and runs of said loops; polymeric filler means capable of withstanding said drying temperatures inserted between said runs in each said helix loop across the entire width of said fabric in said cross-wise direction to close said fabric mesh and control the flow of air through said dryer belt and reduce fluttering of said web of paper thereagainst during drying and a heated sealed seam along edges of said fabric sealing said filler means and fabric providing integral fabric structure.

2. The apparatus of claim 1 wherein said filler includes elongated strands of polymeric material having an oblong cross-section.

3. The apparatus of claim 1 wherein said filler means includes elongated cross-wise strands having a generally flat rectangular cross-section.

4. The apparatus of claim 1 wherein said filler means includes an elongated strip of polymeric material heated after insertion to cause expansion of said filler means more completely closing said fabric to substantially reduce the permeability thereof and maintain said filler means and helix fabric tightly together as integral fabric structure.

5. The apparatus of claim 1 wherein said filler means includes strips of low-melt polymeric material.

6. The apparatus of claim 5 wherein said low-melt polymeric material has a melting point of approximately 350 degrees farenheit at which it begins to swell and expand.

7. The apparatus of claim 4 wherein said low-melt polymeric material has a melt point of approximately 350 degrees farenheit at which it begins to swell and expand.

8. A method of drying a web of paper material which includes passing the web through a dryer having a plurality of heated cylinders, holding said web in contact against said heated cylinders by contacting said web with an endless travelling dryer fabric, said dryer fabric having controlled air passage which permits passage of air therethrough and through said web of paper without excessive sheet flutter due to air pumping through said fabric, said method including providing an endless travelling dryer fabric which comprises:

a plurality of elongated helix means extending in a cross-wise direction constructed from a polymeric material characterized by stress and heat resistance to which said fabric is subjected during endless travel about rollers at elevated drying temperatures;

joint means joining adjacent ones of said helix means successively together in a machine direction to form an endless belt of desired dimension;

spaced upper and lower generally parallel loop runs included in said helix means defining a smooth generally flat contacting surface;

an open mesh defined in said fabric between adjacent joint means and runs of said loops along the cross-wise and machine dimensions of said fabric through which heated vapor and the like flow and are transferred outwardly from said paper web;

polymeric filler means inserted across said helix means closing said mesh to reduce said flow and control air pumping through said fabric and reduce fluttering of said web of paper thereagainst;

means sealing edges of said fabric retaining said filler means and helix means as integral fabric structure.

9. The apparatus of claim 8 wherein said filler means inclues elongated cross-wise strands having a generally flat rectangular cross-section.

10. The apparatus of claim 8 wherein said filler includes elongated strands of polymeric material having an oblong cross-section.

11. The method of claim 8 wherein said fabric includes at least a pair of elongated strands of said filler material inserted between next adjacent joint means.

12. The method of claim 8 wherein said filler means is provided by a filler strip inserted in said helix means across the width of said fabric and heated to expand and more completely and tightly fill same substantially closing said mesh and providing a more integral fabric structure.

13. A method of constructing a dryer fabric for a dryer section of a papermaking machine so as to have a desired permeability and control of air flow therethrough comprising:

providing a series of elongated helix means oriented in a cross-wise direction in said fabric constructed from a polymeric material having open helix loops defined by upper and lower generally parallel loop runs of said material;

joining said helix means successively to one another to form a basic endless dryer fabric of desired dimension in a machine direction having a paper contacting surface which includes an open mesh permeable to fluids;

closing said mesh of said basic dryer fabric by inserting polymeric filler means inside said helix loops across the entire width of said fabric in said cross-wise direction to reduce the permeability of said fabric and control the flow of air through said fabric and reduce paper flutter during drying; and sealing lateral edges of said polymeric fabric to retain said fabric and filler means as integral fabric structure.

14. The method of claim 13 wherein the step of closing said open mesh includes inserting at least one strand of polymeric material inside each said helix loop and subjecting said fabric to heat-treatment causing said strand to flow and expand to thereby more completely occupy said loop and mesh area than in its untreated state.

15. The method of claim 13 wherein said filler means is provided by a strand of polymeric material having a generally flat configuration.

16. The method of claim 13 including heat treating said basic fabric to heat set said fabric making same thermally stable.

17. The apparatus of claim 13 wherein said filler includes elongated strands of polymeric material having an oblong cross-section.

18. The method of claim 13 wherein said fabric includes at least a pair of elongated strands of said filler material inserted between next adjacent joint means.

19. The method of claim 14 including heat treating said polymeric material at a temperature below the heat set temperature of said basic fabric.

20. The method of claim 19 wherein said fabric is heat set at a temperature of approximately 420 degrees farenheit.

21. The method of claim 19 including heat treating said fabric prior to heat treating said filler strip.

22. The method of claim 19 including heat treating said filler strip prior to and simultaneously with heat treating said basic fabric.

23. A dryer belt fabric for use with apparatus for drying a web of paper material in a dryer section of a papermaking machine which includes a plurality of heated cylinders over which the web travels for drying and said fabric is arranged as an endless traveling dryer belt carried about rollers and adjacent said cylinders contacting said web to hold said web against said heated cylinders forcing out air in an area between said web and cylinder for drying, wherein said dryer belt fabric comprises:

a non-woven heat set fabric which includes a plurality of elongated helix means extending in a cross-wise direction constructed from a polymeric material having a degree of plasticity of accommodating stress during repeated travel over said rollers at elevated drying temperatures;

said helix means including flattened loops having generally parallel upper and lower runs of said material presenting asmooth generally flat web contacting surface;

joint means joining adjacent ones of said helix means successively together in a machine direction to provide an endless dryer belt of desired dimension; an open fabric mesh defined between said joint means and runs of said loops through which air flows;

polymeric filler means capable of withstanding said drying temperatures inserted between said runs in each said helix loop across the entire width of said fabric in said cross-wise direction to close said fabric mesh and control the flow of air through said dryer belt and reduce fluttering of said web of paper against said fabric during drying; and a heat sealed seam along edges of said fabric sealing said filler means and fabric providing integral fabric structure.

24. The apparatus of claim 1 wherein said filler means including an elongated strand of a low-melt polymeric material having a melt point below the heat set point of said fabric at which said material begins to swell and flow.

* * * * *